US008318652B2

(12) United States Patent
Fernandes et al.

(10) Patent No.: US 8,318,652 B2
(45) Date of Patent: Nov. 27, 2012

(54) COLORED SPECKLES COMPRISING A POROUS CARRIER AND A RELEASING AGENT LAYER

(75) Inventors: Gregory Fernandes, Greenville, SC (US); Eduardo Torres, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 12/851,616

(22) Filed: Aug. 6, 2010

(65) Prior Publication Data

US 2011/0053823 A1 Mar. 3, 2011

Related U.S. Application Data

(60) Provisional application No. 61/236,707, filed on Aug. 25, 2009.

(51) Int. Cl.
*C11D 7/14* (2006.01)
*C11D 3/40* (2006.01)

(52) U.S. Cl. ..... 510/349; 510/276; 510/343; 510/438; 510/441; 510/507; 510/511; 510/531; 510/532

(58) Field of Classification Search ..... 510/276, 510/343, 349, 438, 441, 507, 511, 531, 532
See application file for complete search history.

(56) References Cited

U.S. PATENT DOCUMENTS

| | | | | |
|---|---|---|---|---|
| 3,595,798 | A | 7/1971 | Smith et al. | 252/95 |
| 4,097,418 | A * | 6/1978 | Rolfes | 510/534 |
| 4,196,103 | A | 4/1980 | Richter | 252/541 |
| 4,434,068 | A * | 2/1984 | Delwel et al. | 510/442 |
| 4,488,972 | A | 12/1984 | Weinstein | 252/8.6 |
| 4,663,152 | A * | 5/1987 | Barth et al. | 424/49 |
| 5,605,883 | A * | 2/1997 | Iliff et al. | 510/444 |
| 6,281,187 | B1 * | 8/2001 | Smerznak | 510/418 |
| 6,384,008 | B1 * | 5/2002 | Parry | 510/414 |
| 6,436,889 | B1 | 8/2002 | Sta et al. | 510/298 |
| 6,541,437 | B2 | 4/2003 | Mendez Mata et al. | 510/348 |
| 7,002,051 | B2 * | 2/2006 | Bonelli et al. | 510/301 |
| 7,033,983 | B2 * | 4/2006 | Beers et al. | 510/344 |
| 2001/0053757 | A1 * | 12/2001 | Mendez Mata et al. | 510/499 |
| 2003/0087791 | A1 * | 5/2003 | Bonelli et al. | 510/444 |
| 2003/0162680 | A1 | 8/2003 | Sta et al. | 510/298 |
| 2003/0166489 | A1 * | 9/2003 | Van Asten et al. | 510/440 |
| 2004/0018955 | A1 * | 1/2004 | Wevers et al. | 512/27 |
| 2005/0148486 | A1 * | 7/2005 | Schramm et al. | 510/419 |
| 2006/0111264 | A1 | 5/2006 | Smets et al. | 510/475 |
| 2010/0125957 | A1 * | 5/2010 | Hong et al. | 8/524 |
| 2010/0132134 | A1 * | 6/2010 | Smets et al. | 8/441 |

FOREIGN PATENT DOCUMENTS

| | | | |
|---|---|---|---|
| EP | 1113068 | 7/2001 | |
| GB | 2194793 | 3/1988 | |
| WO | 98/16615 | 4/1998 | |
| WO | 00/61718 | 10/2000 | |
| WO | 03/018740 | * 3/2003 | |
| WO | 2004/050818 | 6/2004 | |
| WO | 2006/053598 | 5/2006 | |
| WO | 2006/099964 | 9/2006 | 3/12 |
| WO | 2007/006357 | * 1/2007 | |
| WO | 2007/096052 | 8/2007 | |

OTHER PUBLICATIONS

PCT International Search Report dated Dec. 7, 2010 PCT/US2010/002323.

* cited by examiner

*Primary Examiner* — Charles Boyer
(74) *Attorney, Agent, or Firm* — Brenda D. Wentz

(57) ABSTRACT

This invention relates to non-bleeding and quick color releasing colored speckles for use in granular laundry detergents and other consumer products. The speckles are comprised of a porous carrier, a releasing agent, and a coloring agent.

10 Claims, No Drawings

COLORED SPECKLES COMPRISING A POROUS CARRIER AND A RELEASING AGENT LAYER

CROSS REFERENCE TO RELATED APPLICATIONS

This application claims priority to U.S. Provisional Patent Application No. 61/236,707, entitled "Colored Speckles" which was filed on Aug. 25, 2009, and which is entirely incorporated by reference herein.

FIELD OF THE INVENTION

This invention relates to non-bleeding and quick color releasing colored speckles for use in granular laundry detergents and other consumer products. The speckles are comprised of a porous carrier, a releasing agent, and a coloring agent.

BACKGROUND OF THE INVENTION

Recently there has been an increasing trend towards the incorporation of colored speckles into particulate laundry detergent compositions and other consumer products. Dyes and pigments have been widely used to produce colored speckles that serve aesthetic purposes only. Novel effects such as release of color into the wash water and hueing of fabrics, however, tend to require higher colorant loadings. There is, particularly at these higher colorant loadings, a fabric staining risk associated with dye and pigment use. Thus, the need exists for colored speckles for use in detergent compositions and other consumer products that can serve both an aesthetic purpose and also provide the novel effects of release of color and hueing of fabrics without staining the substrates that come into contact with the colored speckles.

Additionally, the inclusion of colored speckles in granulated laundry detergents presents the problem of bleeding or transferring of color onto the powdered detergent surrounding the speckle. This results in the base powder becoming colored, which is a highly undesirable effect. Thus, the need exists for colored speckles for use in detergent compositions which do not bleed or transfer to the surrounding base powder.

Attempts by others to include colored speckles in detergents include, for example, U.S. Pat. No. 4,097,418 to Rolfes. This patent discloses the use of colored speckles in granular detergent compositions. The colored speckles are comprised of a water soluble inorganic alkaline salt which acts as a carrier for the coloring agent. The coloring agent may be a water-soluble dye or a water-insoluble pigment. U.S. Pat. No. 6,541,437 to Mata et al. discloses the use of glassy phosphate particles as carriers for dyes and/or pigments. The colored particles may be added to a detergent formulation to aid in improving its cleaning performance.

Yet another example includes WO 2006/099964 A1 to Andrade et al. which discloses the use of a speckle granule comprised of a clay mineral carrier and a mica pigment. To increase the rate of dispersion of the granule in the wash liquor, this reference teaches the inclusion of a soluble builder salt, such as sodium tripolyphosphate, admixed with the clay in the granule. A water-soluble polymeric coating, such as polyvinyl alcohol, may also be added to the granule, to help prevent the mica from leaving the clay during storage and handling.

The problems associated with previous attempts by others to include colored speckles in detergents include fabric staining from the colorant used in the speckles, bleeding and transferring of the colorant to the surrounding detergent powder, and failure of the speckle to release the colorant rapidly into the wash water. The present disclosure addresses and overcomes these problems.

The colored speckles of the present disclosure are ideally suited for providing color to various other compositions including, but not limited to granular detergent compositions (such as laundry detergent compositions). The colored speckles may provide non-staining, aesthetically-pleasing features to textile substrates treated therewith. They also resist bleeding or transferring to the surrounding detergent composition. Furthermore, the colored speckles of the present disclosure quickly release color from the porous carrier and provide desirable color to the wash water. For these reasons, and others that will be described herein, the present colored speckles represent a useful advance over the prior art.

BRIEF SUMMARY OF THE INVENTION

Provided herein is a colored speckle comprising a majority by weight of at least one porous carrier material; at least one releasing agent selected from the group consisting of salt compounds, sugar compounds, alkoxylated aromatic compounds, glycols, high molecular weight alcohols, solvents having a boiling point above 60° C., and mixtures thereof; and at least one coloring agent.

Yet another alternative includes a colored speckle comprising a majority by weight of at least one porous carrier material selected from clays, silicas, zeolites, metal oxides, diatomaceous earth, mica, talc, chalk, gypsum-containing compounds, leaded zinc oxide, zinc oxide, zinc sulfide, lithopone, titanium dioxide, calcium sulfate, antimony oxide, magnesium silicate, barytes, basic lead carbonate, calcium carbonate, calcium sulfate, barium sulfate, calcium silicate, silica flatting agents, aluminum silicate, hydrous aluminum silicates, magnesium silicates, calcium metasilicate, sodium-potassium-aluminum silicate, sodium tripolyphosphate, sodium silicate, soda ash-containing compounds, and combinations thereof; at least one releasing agent selected from the group consisting of salt compounds, sugar compounds, alkoxylated aromatic compounds, glycols, high molecular weight alcohols, solvents having a boiling point above 60° C., and mixtures thereof; and at least one polymeric coloring agent.

Further provided herein is a colored speckle comprising at least one porous carrier material, wherein the at least one porous carrier material is characterized by having a plurality of pores, a first layer comprising at least one releasing agent, wherein the releasing agent is in direct contact with at least a portion of the plurality of pores of the at least one porous carrier material, and a second layer comprising from about 0.01% to about 10% by weight of at least one coloring agent, wherein the colorant agent is in direct contact with at least a portion of the releasing agent layer.

Further provided herein is a colored speckle comprising at least one porous carrier material, wherein the at least one porous carrier material is characterized by having a plurality of pores, and a mixture of at least one releasing agent and at least one coloring agent.

Another embodiment includes a method for forming a colored speckle comprising the steps of providing at least one porous carrier material; applying at least one releasing agent to the at least one porous carrier material to form a carrier-releasing agent composite; and applying at least one coloring agent to the carrier-releasing agent composite to form the colored speckle.

Yet another alternative is a method for forming a colored speckle comprising the steps of providing at least one porous carrier material; applying a mixture of at least one releasing agent and at least one coloring agent to the at least one porous carrier material to form the colored speckle.

DETAILED DESCRIPTION OF THE INVENTION

All U.S. and foreign patents and U.S. patent applications disclosed in this specification are hereby incorporated by reference in their entirety.

The present disclosure relates to non-bleeding and quick color releasing colored speckles for use in granular detergent compositions. The colored speckles are comprised of porous granules made from water-dispersible or water soluble materials which act as a carrier for a coloring agent and a releasing agent. The porous carrier provides good resistance to color bleeding into the surrounding detergent composition. The combined use of a releasing agent with the carrier allows for quick release (i.e. in less than 5 minutes) of the coloring agent from the carrier and into the wash water. Herein, the present disclosure describes a colored speckle and a method for making the colored speckle which drastically improves the coloring agent release time, while still preserving the bleed resistance that the carrier provides.

The term "non-staining" as used herein, generally refers to a coloring agent, or a composition that contains such a coloring agent, that may be washed or removed from substrate surfaces (e.g. skin, fabric, wood, concrete) with relatively little effort and without staining the substrate to an appreciable extent.

The term "non-bleeding," as used herein, generally refers to a coloring agent-containing composition that does not substantially color the material surrounding the composition under conditions wherein the material is not intended to be colored. For example, the colored speckles of the present invention will generally be considered to be "non-bleeding" if the colored speckles fail to substantially color the surrounding powdered detergent in its unused state (i.e. while it remains in the package).

Without being bound by theory, it is believed that a porous granule, or carrier, has, by virtue of its form and/or structure, an abundance of pores both on its surface as well as in its interior that have a certain distribution of sizes, depths and tortuosity. A coloring agent applied to porous granules would be drawn into these pores via capillary action, thereby being more "protected" or "shielded" from the external environment than if it were to rest only on the surface of the granule, which is believed to occur in a non-porous material contacted with a coloring agent. Furthermore, it is believed that the physical "protection" or "shielding," due to the porous nature of the granule, is a contributing factor to providing bleed protection to a colored speckle that contains the granule. Thus, when present in wash water, the release rate of the coloring agent from such porous granules may then depend on the rate of disintegration, swelling or dispersion of the granule. These factors may result in a slower release of color from porous granules as compared to non-porous granules (again, where the coloring agent would be present only on the outer surface of the granule).

Another factor to consider is the interaction between the coloring agent and the material comprising the porous granule (e.g. clay). Favorable interaction between the coloring agent and the granule, or carrier, which may be provided by such by binding forces, adsorption, and the like, may further enhance the bleed resistance of the resulting colored speckle. However, if the interaction is too strong, it could inhibit the release rate of the coloring agent from the colored speckle into the wash water, even if the colored speckle granules disintegrates rapidly.

To eliminate or reduce the possibility that this interaction between the coloring agent and the carrier granule will hinder the release of the coloring agent, the coloring agent may be applied to the carrier in such a way that it is in contact (either absorbed or adsorbed) with a releasing agent, rather than with the carrier. The releasing agent acts to prevent and/or reduce the coloring agent's interaction with the inner walls of the pores of the granule. The coloring agent may be primarily in contact with the releasing agent, rather than with the surfaces of the carrier.

In one non-limiting embodiment, this structural arrangement of carrier to releasing agent to coloring agent may be achieved by adding a releasing agent to the inner walls or surfaces of the porous granule before application of the coloring agent. Forces such as capillary action may draw the coloring agent into the pores where the coloring agent is shielded from the external environment. This allows the coloring agent to be primarily in physical contact with the releasing agent and not in direct contact with the walls or surfaces of the porous granule, or carrier.

Without being bound by theory, it is believed that modification of the porous granule with a releasing agent results in a release rate of the coloring agent from the porous granules that is independent of the many factors that could detrimentally affect it (e.g. that would slow down the release rate). These factors include the rate of swelling, disintegration and dispersion of the porous granule or of the binding and/or adsorption forces that hold the coloring agent to the porous granule. As a result, the porous granule, or carrier, having a releasing agent applied thereto, provides the desired dual benefit of bleed stability and rapid color release in wash water.

Additionally, the amount of releasing agent required to deliver rapid release of the coloring agent from the porous granules may be directly dependent on the "porosity" of the granules, carriers, which includes factors like pore size distribution, depth and tortuosity of the pores, and the rate of disintegration of the granules. It is also believed that the strength of the interaction between the coloring agent and the carrier or carrier material may also have an effect on these desired features.

Carrier

The carrier is preferably in the form of a porous granule which is characterized by having a plurality of pores. The colored speckle may be comprised of a majority by weight of the carrier. The material used to produce the porous granule may be characterized as a water dispersible material. Suitable carrier materials that may be granulated to form these porous granules, or carriers, may be selected from compounds containing and/or including, but not limited to clays, silicas, zeolites, metal oxides, diatomaceous earth, mica, talc, chalk, gypsum-containing compounds, leaded zinc oxide, zinc oxide, zinc sulfide, lithopone, titanium dioxide, calcium sulfate, antimony oxide, magnesium silicate, barytes, basic lead carbonate, calcium carbonate, calcium sulfate, barium sulfate, calcium silicate, silica flatting agents, aluminum silicate including hydrous aluminum silicates, magnesium silicates, calcium metasilicate, sodium-potassium-aluminum silicate, and the like, and combinations thereof. Suitable examples of water soluble carriers include detergency builders such as sodium tripolyphosphate, sodium silicate, soda ash-containing compounds, and the like, and combinations thereof.

Examples of clay materials include bentonite, kaolin, smectite, illite, chlorite, hormite, beidelite, sepiolite, alunite, hydrotalcite, nontronite, hectorite, attapulgite, pimelite, muscovite, willemseite, minnesotaite, antigorite, amesite, china clay, halloysite, and the like, and combinations thereof. Commercially available examples of suitable clay carriers include Pelben® 10 and Pelben® 35 (available from Buntech, a Brazilian company). Suitable examples of clay powders include Argel® 10 and Argel® 40 (available from Buntech).

Bentonites are clays that are comprised primarily of, and whose properties are typically dictated by a smectite clay mineral (e.g. montmorillonite, hectorite, nontronite, etc.). Smectites are generally comprised of stacks of negatively charged layers (wherein each layer is comprised of two tetrahedral sheets attached to one octahedral sheet; the tetrahedra formed by silicon and oxygen atoms and the octahedra formed by aluminum and oxygen atoms together with hydroxyl radicals) balanced and/or compensated by alkaline earth metal cations (e.g. $Ca^{2+}$ and/or $Mg^{2+}$) and/or alkali metal cations (eg. $Na^{+}$ and/or $K^{+}$). The relative amounts of the two types (alkaline earth metal and alkali metal) of cations typically determine the swelling characteristic of the clay material when placed in water. Bentonites, in which the alkaline earth metal cation $Ca^{2+}$ is predominant (or is in a relative majority), are called calcium bentonites; whereas, bentonites in which the alkali metal cation $Na^{+}$ is predominant (or is in a relative majority) are called sodium bentonites.

The term "natural," as used herein with respect to clay material, refers to the presence of the mineral in deposits found in the earth (formed via modification of volcanic ash deposits in marine basins by geological processes). Accordingly, a natural deposit of bentonite containing primarily (or a relative majority of) $Na^{+}$ cations is referred to as "natural sodium bentonite;" whereas, a natural deposit of a bentonite predominantly containing (or containing a relative majority of) $Ca^{2+}$ cations is referred to as "natural calcium bentonite."

Synthetic analogues of Na and Ca bentonite may also be synthesized (by using hydrothermal techniques, for example). "Synthetic sodium bentonite" may also refer to bentonite obtained by treatment of calcium bentonite with, but not limited to, sodium carbonate or sodium oxalate (to remove the calcium ion and substitute it with a sodium ion). This treatment can be varied to impart different levels of ion-exchange or $Na^{+}$ for $Ca^{2+}$ substitution. Herein, these materials are referred to as "partially activated" and "fully activated" grades of clay material, respectively (with "fully" referring to maximum exchange of $Ca^{2+}$ for $Na^{+}$).

One of the reasons for converting calcium bentonite into synthetic sodium bentonite is to impart greater swelling properties to otherwise (relatively) non-swelling calcium bentonite. There is also an aesthetic benefit associated with synthetic sodium bentonite that is lacking in natural sodium bentonite. Natural sodium bentonite (generally, irrespective of the part of the world in which the deposit is located) is colored. The color ranges from brown to yellow to gray. By comparison, natural calcium bentonite has a more aesthetically pleasing white color. Consequently, synthetic sodium bentonite that is obtained by treatment of this white calcium bentonite is also white. As a result, natural calcium bentonite and synthetic sodium bentonite find more widespread use in the detergent industry, as compared to natural sodium bentonite.

Applicants' studies have shown considerable differences in the propensity of certain coloring agents to stain fabrics depending on the type of bentonite clay (in the form of a colored clay speckle or colored clay powder) to which the coloring agents have been applied (natural sodium vs. natural calcium bentonite; natural sodium bentonite vs. synthetic sodium bentonite; partially vs. fully activated synthetic sodium bentonite). It has been discovered that, at equal color loading, natural sodium bentonite display considerably lower propensity for staining than calcium bentonite. It has also been discovered that, at equal color loading, synthetic sodium bentonite exhibits lesser staining risk than calcium bentonite. However, at equal color loading, even fully activated synthetic sodium bentonite shows greater staining than natural sodium bentonite. The same observations were made independent of whether the color was applied to a bentonite speckle or a bentonite powder.

Without being bound by theory, it is believed that clays with higher swelling properties provide reduced staining risk for coloring agents applied thereto. However, the appearance of a colored speckle made from natural sodium bentonite may need to be improved, due to the yellow/gray/brown coloration of the natural sodium bentonite. The considerable reduction in the staining risk observed by the use of natural sodium bentonite indicates that it may be possible to blend natural sodium bentonite with a whiter bentonite (such as calcium bentonite or synthetic sodium bentonite or mixtures thereof), thereby resulting in a speckle with a whiter appearance than a 100% natural Na-bentonite speckle, but with lower staining risk than 100% Ca and synthetic sodium Bentonite speckles.

The material used to produce the porous granule may also be a water soluble material that does not have a rapid rate of dissolution (e.g. phosphates). The term "rapid" is intended to describe a dissolution rate that will allow the quick and/or instant release of the coloring agent into a wash water solution.

It may be preferable that the carrier exhibits a particular range of particle size, as determined, for example, by sieving techniques according to ASTM D1921-06 ("Standard Test Method For Particle Size (Sieve Analysis) of Plastic Materials"). Alternative methods known to those skilled in the art may also be utilized for determining particle size. For example, other sieving techniques may be used or electronic laboratory equipment known for determining particle size may alternatively be employed. For the carriers of the present invention, it may be preferably that the carriers exhibit an average particle size of about 0.1 mm to about 2 mm, more preferably an average particle size of about 0.3 mm to about 1.2 mm.

Coloring Agent

The coloring agent of the present invention is preferably a polymeric colorant. The term "polymeric colorant" generally refers to a colorant having at least one chromophore portion attached to at least one oligomeric or polymeric chain, wherein the chain has at least three repeating units. The oligomeric or polymeric constituent can be bound to the chromophore via any suitable means, such as a covalent bond, an ionic bond, or suitable electrostatic interaction. Generally, the polymeric colorant may be characterized by having an absorbance in the range of between about 300 nanometers and about 900 nanometers, as measured by UV-vis spectroscopy.

As a function of its manufacturing process, the polymeric colorant has a molecular weight that is typically represented as a molecular weight distribution. Accordingly, the molecular weight of the polymeric colorant is generally reported as an average molecular weight, as determined by its molecular weight distribution.

The chromophore group of the colorant may vary widely, and may include compounds characterized in the art as dyestuffs or as pigments. The actual group used will depend to a large extent upon, for instance, the desired color and colorfastness characteristics. The chromophore group may be attached to at least one polyalkyleneoxy-substituent through a suitable linking moiety of nitrogen, oxygen, sulfur, etc.

Examples of chromophore groups include nitroso, nitro, azo (including monoazo, disazo, trisazo, tetrakisazo, polyazo, formazan, azomethine and metal complexes thereof), stilbene, diarylmethane, triarylmethane, xanthene acridine, quinoline, methine (including polymethine), thiazole, indamine, indophenol, azine, thiazine, oxazine, aminoketone, hydroxyketone, anthraquinone (including anthrapyrazolines, anthrone, anthrapyridone, anthrapyrimidine, flavanthrone, pyranthrone, benzanthrone, perylene, perinone, naphthalimide and other structures formally related to anthraquinone), indigoid (including thioindigoid), phthalocyanine chromophore groups, and mixtures thereof.

Examples of suitable polymeric chains are polyalkyleneoxy chains. The term "polyalkyleneoxy," as used herein, generally refers to molecular structures containing the following repeating units: —$CH_2CH_2O$—, $CH_2CH_2CH_2O$—, —$CH_2CH_2CH_2CH_2O$—, —$CH_2CH(CH_3)O$—, —$CH_2CH(CH_2CH_3)O$—$CH_2CH_2CH(CH_3)O$—, and any combinations thereof.

Typical of such groups which may be attached to the chromophore group are the polymeric epoxides, such as the polyalkylene oxides and copolymers thereof. Typical polyalkylene oxides and copolymers of same which may be employed to provide the colorants include those made from alkylene oxide monomers containing from two to twenty carbon atoms, or more preferably, from two to six carbon atoms. Examples include: polyethylene oxides; polypropylene oxides; polybutylene oxides; oxetanes; tetrahydrafurans; copolymers of polyethylene oxides, polypropylene oxides and polybutylene oxides; and other copolymers including block copolymers, in which a majority of the polymeric substituent is polyethylene oxide, polypropylene oxide and/or polybutylene oxide. Further, such polyalkyleneoxy group may have an average molecular weight in the range of from about 132 to about 10,000, preferably from about 176 to about 5000.

It is to be understood that because the colorants may not ordinarily be chemically bound to the carrier, the precise chemical identity of the end group on the polyalkyleneoxy group may not be critical insofar as the proper functioning of the colorant is concerned in the composition. With this consideration in mind, certain most preferred colorants will be defined wherein certain end groups will be identified. Such recitation of end groups is not to be construed as limiting the invention in its broader embodiments in any way. According to such a most preferred embodiment the colorants may be characterized as follows:

$$R\{A[(\text{alkyleneoxy constituent})_n R_1]_m\}_x$$

wherein R is an organic chromophore group, A is a linking moiety in said organic chromophore group selected from the group consisting of N, O, S or $CO_2$, the alkylene moiety of the alkyleneoxy constituent contains from 2 to about 4 carbon atoms, n is an integer of from 2 to about 230, m is 1 when A is O, S, $CO_2$ and 1 or 2 when A is N, x is an integer of from 1 to 5, and the product of n times x times m (n.m.x) is from 2 to about 230, and $R_1$ is a member of the group consisting of

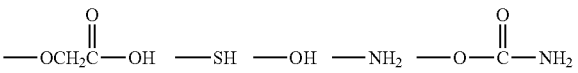

-continued

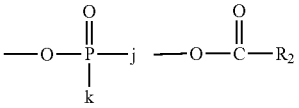

and sulfonates and sulfates of each of the members of said group, wherein $R_2$ is H, an alkyl radical containing up to about 20 carbon atoms or carboxy-terminated alkyl radical containing up to about 20 carbon atoms, j and k are OH, OM or $OR_3$ wherein M is a cation moiety of an alkali metal, an alkaline earth metal, transition metal, e.g., nickel, etc. or ammonium, and $R_3$ is an alkyl radical containing up to about 20 carbon atoms.

The oligomeric constituent can be any suitable constituent including, but not limited to, oligomeric constituents selected from the group consisting of (i) oligomers comprising at least three monomers, or repeating units, selected from the group consisting of $C_2$-$C_{20}$ alkyleneoxy groups, glycidol groups, and glycidyl groups, (ii) aromatic or aliphatic oligomeric esters conforming to structure (I)

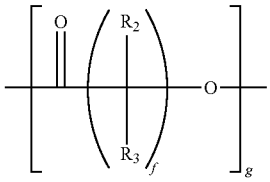

(I)

and (iii) combinations of (i) and (ii). In structure (I), $R_2$ and $R_3$ are independently selected from the group consisting of hydrogen and $C_1$-$C_{10}$ alkyl groups, f is an integer between and including 1 and 10, and g is any positive integer or fraction between and including 1 and 20. As will be understood by those of ordinary skill in the art, suitable values for g include both integers and fractions because the length of the oligomeric constituent on the individual polymeric colorant molecules may vary. Thus, the value for g represents an average length of the ester chain for a given sample or collection of polymeric colorant molecules. In certain embodiments, the polymeric colorant can comprise one or more oligomeric constituents consisting of three or more ethylene oxide monomer groups.

Exemplary polymeric colorants include Liquitint® polymeric colorants, Cleartint® polymeric liquid concentrate colorants, Reactint® polymeric colorants, and Palmer® polymeric colorants, all of which are available from Milliken Chemical, a division of Milliken & Company of Spartanburg, S.C. Liquitint® polymeric colorants are characterized in that they are water soluble, non-staining, colorants. They are widely used in laundry detergents, fabric softeners, and other consumer and industrial cleaning products. Liquitint® polymeric colorants are generally bright liquid colorants which exhibit excellent solubility in water, are compatible with other chemicals present in their end-use formulations, and are easy to handle. Liquitint® polymeric colorants may be used to provide color in both aqueous and solid systems. The unique polymeric nature of Liquitint® polymeric colorants provides reduced staining to skin, textiles, hard surfaces, equipment, and the like.

Cleartint® polymeric liquid concentrate colorants are specially designed liquid colorants often used for coloring clarified polypropylene articles. These colorants may be incorporated into polypropylene resins easily without detrimentally affecting the clarity of the article to provide transparent, clear and brightly colored polypropylene articles. Cleartint® liquid concentrate polymeric colorants are oligomeric coloring materials which combine the exceptional aesthetics of dyes with the migration resistance of pigments. These colorants may be used as light tints to mask residual haze, or they may be used for deep, rich shades that are not possible with pigment colorants. Cleartint® liquid concentrate polymeric colorants allow clarified polypropylene to rival the beauty of higher cost plastic materials. The technical and physical property benefits of clarified polypropylene may be exploited without sacrificing product aesthetics.

Reactint® polymeric colorants are liquid polymeric colorants useful for coloring polyurethane and other thermoset resins. These colorants are reactive polymeric colorants that consist of chromophores which are chemically bound to polyols. This arrangement allows the polymeric colorant to react into the polyurethane polymer matrix. Unlike pigment pastes, which are dispersions of solid particles in a liquid carrier, Reactint® polymeric colorants are 100% homogeneous liquids that are soluble in polyol and will not settle over time. Because of this pure liquid and easy to disperse nature, it is possible to blend Reactint® colorants in-line and on-the-fly, while producing polyurethane foams and resins.

Palmer® polymer colorants are liquid colorants specially developed for use in washable applications, such as in markers, paints and other art products. They contain no heavy metals, are non-toxic, and have excellent non-staining properties on skin, fabric and other surfaces. Palmer® polymeric colorants have very good compatibility with aqueous ink formulations and provide bright colors.

It is also contemplated to be within the scope of the present invention that other colorants may be utilized as the coloring agent. For example, a colorant selected from one or more of the following classes may be suitable for use as the coloring agent in the colored speckle: acid dyes, basic dyes, direct dyes, solvent dyes, vat dyes, mordant dyes, indigoid dyes, reactive dyes, disperse dyes, sulfur dyes, fluorescent dyes; pigments, both organic and inorganic; natural colorants; and the like.

Releasing Agent

The releasing agent is generally used to effectuate the quick release of the coloring agent from the carrier. The releasing agent may be any material that is soluble or miscible in water at room temperature, though for ease of processing, it may be advantageous to use materials with moderate-to-high solubility in water (e.g. 20 g-200 g releasing agent/100 g water at 20° C.). It may be advantageous if the releasing agent is a solid in its pure form at room temperature. The solid releasing agent may be ionic in nature (e.g. salts such as magnesium sulfate, sodium sulfate, sodium carbonate, sodium chloride, and the like), non-ionic (e.g. sugars such as sucrose, fructose, and the like), or a mixture of ionic and non-ionic.

The releasing agent may also be a water-dispersible solid. However, in such instances, the coloring agent may exhibit a weaker binding affinity for the water dispersible releasing agent than for the carrier and/or the carrier material. Suitable examples of such releasing agents may be dependent upon and specific to the desired coloring agents utilized for the colored speckles.

The releasing agent may also be a soluble or miscible material that is not a solid at room temperature. Rather, the releasing agent may be a liquid or a wax in its pure form at room temperature. Some examples of these types of releasing agents include alkoxylated aromatic compounds (such as alkoxylates of m-toluidine), glycols (such as polyethylene glycol), high molecular weight alcohols (such as ethanol, propanol, hexanol, and butanol), solvents having a boiling point above 60° C. (such as dipropyl ether, ethylene glycol dimethyl ether, and toluene), and the like, and mixtures thereof.

The alkoxylated form of m-toluidine may be alkoxylated with one or more of the following groups: ethylene oxide (EO), propylene oxide (PO), butylene oxide (BO), and any mixtures thereof. The average number of groups forming the alkoxylated portion of m-toluidine may be from about 1 to about 200, more preferably from about 1 to about 100, and most preferably from about 1 to about 50.

One potential advantage of a solid releasing agent is that, in theory, it may be "fixed" at any position along the inner walls of the pores of the carrier granule (in the form of a coating on the walls of the pores, wherein the coating may be discontinuous or continuous) to form a non-migrating physical barrier between coloring agent and the carrier. For rapid color release into solution, it may be particularly advantageous to have the releasing agent "fixed" inside the pores but close the carrier granule surface so that a sustained rapid release of the coloring agent into wash water solutions months or years after the speckles are produced is achieved. This effect may not be achievable with liquid releasing agents, since they may continue to migrate into the core of the granule over time.

The amount of releasing agent present in the colored speckle may vary depending upon the nature of the porous carrier material or carrier and the desired performance of the resulting colored speckle. It may be desirable that the amount of releasing agent is enough to achieve sufficient release of the coloring agent into wash water. Greater amounts of releasing agent would not compromise the enhancement in the release rate, but too much releasing agent would compromise the bleed protection that the porous carrier provides. As a result, the optimum ratio of porous carrier to releasing agent may be the highest carrier to releasing agent ratio at which enhanced color release is enabled and which does not compromise bleed protection.

Thus, it may be desirable that the weight ratio of carrier to releasing agent is in the range of 1000:1 to 1:1, more preferably 500:1 to 1:1, even more preferably from 50:1 to 1:1, and most preferably from 20:1 to 1.5:1. In other instances, it may be preferable that the weight ratio of carrier to releasing agent is 5 parts by weight of carrier to 2 parts by weight of releasing agent.

Optional Additives

Optional additives that may be included in the colored speckles include perfumes, enzymes, bleach activators, bleaches, bleach catalysts, bleach stabilizers, foam regulators (foam boosters and antifoam agents), fluorescent whitening agents, soil repellents, corrosion inhibitors, soil antiredeposition agents, soil release agents, dye transfer inhibitors, builders, complexing agents, ion exchangers, buffering agents, and mixtures thereof. Bleed inhibitors such as film forming polymers or polymeric coatings may also be included. These additives may be included in addition to the coloring agent or as the sole active ingredient into the porous carrier that has been modified with the releasing agent.

Methods for Forming the Colored Speckle

One method for forming the colored speckles of the present invention includes the steps of providing a carrier, loading the carrier into a rotating drum or other suitable mechanical device, and providing heat to the drum. The heat source may include any suitable source of heat that is capable of sufficiently elevating the temperature of the carrier. For example, a heat gun may be utilized. The drum may or may not have baffles or other protrusions attached to its interior walls.

Heat may be applied to the rotating drum in order to elevate the temperature of the carrier to a temperature range of between 30° C. and 90° C., more preferably between 40° C. and 80° C.

After the temperature of the carrier reaches its desired temperature range, a releasing agent may be added to the rotating drum. The releasing agent may be added, preferably in the form of an aqueous solution (for instance, a salt solution), to the drum using any conventional means for adding materials to a container. For example, the releasing agent may be sprayed into the drum. The releasing agent thus comes into contact with the heated carrier. The releasing agent may provide a substantially uniform coating on and/or into the carrier The releasing agent may then be absorbed via capillary action into the pores of the heated carrier. By evaporating of the water from the aqueous releasing agent solution, the releasing agent is deposited on the inner walls or surface of the pores of the porous granules. After completion of this step, the heat source may be removed.

Next, the coloring agent, preferably in the form of an aqueous solution, may be added to the carrier-releasing agent composite that remains in the rotating drum. The coloring agent may be added to the drum using any conventional means for adding materials to a container. For example, the coloring agent may be sprayed into the drum. The coloring agent thus comes into contact with the carrier-releasing agent composite. The coloring agent may provide a substantially uniform coating on and/or into the carrier-releasing agent composite. The resulting colored speckle may have a final color-on-speckle loading of 0.01% to 10%, more preferably of 0.1% to 5%.

The colored speckles may then be dried. Drying may be accomplished by any conventional means known for drying particulate materials.

The general methods for preparing the colored speckle described herein may not be construed as limiting the scope of the present invention. It should be possible, by way of alternative processing methods, to combine the carrier, releasing agent and coloring agent to produce a colored speckle which exhibits similar release profiles for the coloring agent, as well as other desired features, as the colored speckles produced by the general methods described herein and by their equivalent methods as known to those skilled in the art. For instance, it may be possible to combine the releasing agent and the coloring agent together into a mixture and then spray or otherwise apply the mixture to the carrier. It might also be possible to subsequently add additional coloring agent to the carrier. Also, it may be possible that a colored speckle having the desired characteristics may be manufactured by adding the carrier, the releasing agent, and the coloring agent together in one step.

EXAMPLES

The invention may be further understood by reference to the following examples which are not to be construed as limiting the scope of the present invention. The indication of "N/A" is used when no data or no additional data is available.

A. Preparation of Colored Speckles

One or more of the following procedures was used to prepare the colored speckles:

Procedure 1

A coloring agent was sprayed directly on the carrier and no releasing agent was used. The procedure was performed according to the following steps:

1. The carrier was loaded into a rotating drum with baffles. The drum continued rotating for the entire procedure.
2. The coloring agent was sprayed onto the carrier in the rotating drum to form the colored speckles.
3. The colored speckles were then allowed to air dry overnight.

Procedure 2

A releasing agent was applied to the carrier, followed by the addition of a coloring agent. The procedure was performed according to the following steps:

1. The carrier was loaded into a rotating drum with baffles. Heat was applied from a heat gun angled at the side of the barrel. The temperature of the carrier was then monitored. The drum continued rotating for the entire procedure.
2. A solution of releasing agent in water was made.
3. After the temperature of the carrier reached 60° C., the releasing agent solution was sprayed into the rotating drum. After all of the releasing agent solution had been added, the heat was turned off.
4. The carrier-releasing agent composite granules were then sprayed with a coloring agent that had been diluted with water to form the colored speckles. The amount of water for the dilution was determined by the final target color loading desired on the speckle.
5. The colored speckles were then allowed to air dry overnight.

Procedure 3

The releasing agent was combined with the coloring agent to form a releasing agent-coloring agent mixture prior to being added to the carrier. The procedure was performed according to the following steps:

1. The carrier was loaded into a rotating drum with baffles. The drum continued rotating for the entire procedure.
2. A solution comprising one part by weight of Liquitint® Blue HP coloring agent (at 100% solids content) and 3 parts by weight of m-toluidine having, on average, 5 ethylene oxide groups attached to it was made.
3. The releasing agent-coloring agent solution was sprayed onto the carrier in the rotating drum.
4. The colored speckles were then allowed to air dry overnight.

Procedure 4

For some samples, Argel® 10 (a commercially available powder clay product), was used as the carrier. In order to granulate the powder into a particulate form, samples utilizing Argel® 10 were exposed to the following procedure prior to formation of the colored speckles:

1. 50 g Argel® 10 clay carrier material was put into a plastic beaker.
2. 12 g of water was dripped into the plastic beaker with a pipette.

3. The mixture was mixed with a wooden spatula until the water was absorbed into the clay carrier material (the material appeared dry at this point).
4. The water-clay material was then put into a food processor and mixed on the "grind" setting for a few seconds until the material formed uncolored porous carrier particles of the appropriate size.
5. The uncolored carrier particles were then placed on a piece of aluminum foil and dried in a 75° C. oven.
6. Further modifications to these uncolored speckles are detailed in Procedures 1, 2 & 3, as indicated for each example.

Procedure 5

1. 30 g of bentonite powder was measured into a small food processor.
2. The desired amount of color was measured out into a small beaker and diluted with 7.2 g of water.
3. The colored solution was then blended into a powder a little at a time. If the powder began to agglomerate, the sample was put into a 60° C. oven until dry, then pulverized in the food processor. The final powder was passed through a No. 25 sieve. The material that passed through the sieve was used for testing.

B. Spot Staining Test Procedures

The following test procedures were used to evaluate fabric staining:

Spot Staining Test Procedure A

1. Spread the test fabric piece (100% white cotton fabric) in a flat tray having dimensions of 36×24×6 cm.
2. Pour 2 liters of cold water into the tray.
3. Sprinkle detergent powder containing 3% colored speckles evenly on the test fabric and let it stand for 90 minutes.
4. After soak time, rinse fabric under running water and let it air dry.
5. Check the fabric for any visible stains.
6. If staining is observed, wash the fabric in cold water with a detergent that does not contain the colored speckles to see if the stain remains. If the stain washes out completely, then it is not considered a problem.

The numerical rating scale for visual observations of stains on the test fabric was as follows: 5=no staining, 4=very light amount of staining, 3=light amount of staining, 2=medium amount of staining, 1=heavy amount of staining.

Spot Staining Test Procedure B

1. Spread the test fabric piece (100% white cotton fabric) in a plastic tub having dimensions of 36×24×6 cm. The dimensions of the fabric piece are close to that of the tub.
2. Pour 0.5 liters of cold (room temperature) water into the tub.
3. Sprinkle 2 g of colored speckles evenly on the test fabric and let it stand for 90 minutes.
4. After soak time, rinse the fabric twice in a tub of tap water and let it air dry.
5. Visual observations of the fabric were made for any visible stains.
6. Steps 1-5 were repeated to obtain a duplicate test sample. Results provided will be an average of the two test samples.

C. Tests and Evaluation

The following tests were carried out in order to evaluate certain properties of the colored speckles:

Test 1: Benefit of Modifying the Carrier with Releasing Agent

Test 2: Applicability to Other Porous Carriers

Test 3: Use of Other Releasing Agents

Test 4: Bleed Resistance of Colored Speckles

Test 5: Stain Testing of Colored Speckles

Test 6: Benefit of Modifying the Carrier with Releasing Agent: Applicability to Other Classes of Polymeric Colorants and Commercial Dyes Test 7: Evaluation of Staining in Natural vs. Synthetic Clay Carrier Materials Test 8: Evaluation of Staining in Natural vs. Synthetic (Partially and Fully Activated) Clay Carrier Materials Test 9: Evaluation of Staining in Natural vs. Synthetic Clay Carrier Materials As Affected by Particle Size Test 1: Benefit of Modifying the Carrier with Releasing Agent This test illustrates the novel effect and benefit achieved by modifying the porous carrier with a releasing agent.

The following colored speckles were prepared:

Example 1A[2]

| Ingredients | Amount (grams) |
|---|---|
| Pelben ® 10 (pre-granulated sodium-bentonite clay carrier) | 50 |
| Magnesium Sulfate (releasing agent) | 35 |
| Liquitint ® Blue HP (polymeric colorant coloring agent) | 1 |

Comparative Example 1A[1]

| Ingredients | Amount (grams) |
|---|---|
| Pelben ® 10 (clay carrier) | 50 |
| Liquitint ® Blue HP (polymeric colorant coloring agent) | 1 |

Example 1B[2]

| Ingredients | Amount (grams) |
|---|---|
| Pelben ® 10 (clay carrier) | 50 |
| Magnesium Sulfate (releasing agent) | 9 |
| Liquitint ® Blue HP (polymeric colorant coloring agent) | 1 |

Example 1C[2]

| Ingredients | Amount (grams) |
|---|---|
| Pelben ® 10 (clay carrier) | 50 |
| Magnesium Sulfate (releasing agent) | 17 |
| Liquitint ® Blue HP (polymeric colorant coloring agent) | 1 |

Example 1D[2]

| Ingredients | Amount (grams) |
|---|---|
| Pelben ® 35 (pre-granulated sodium-bentonite clay carrier) | 50 |
| Magnesium Sulfate (releasing agent) | 35 |
| Liquitint ® Blue HP (polymeric colorant coloring agent) | 1 |

Comparative Example 1D[1]

| Ingredients | Amount (grams) |
|---|---|
| Pelben ® 35 (clay carrier) | 50 |
| Liquitint ® Blue HP (polymeric colorant coloring agent) | 1 |

[1] Samples made via Procedure 1.

[1] Samples made via Procedure 2.

The resulting colored speckles were added to Tide® powder laundry detergent. One gram of the speckle-containing detergent was added to a clear plastic cup which contained 150 mL of cold water. This mixture was gently stirred with a cotton swap for 30 seconds. The mixture was allowed to rest for 5 minutes, and then the mixture was stirred again with a cotton swap for 5 seconds.

The color of the wash water in the plastic cup was then observed to see if it changed to blue and to determine if sediment was present in the bottom of the cup. The speckles were also evaluated for various parameters such as quickness of the color release into the wash water. "Sediment" refers to the dispersed, water insoluble carrier that settles to the bottom of the cup under gravity. This sediment may have varying degrees of color depending on how much of the color has released into the wash water solution. The observation of no sediment being present is intended to describe that all visible traces of color have come off the speckles; it is not intended to describe the actual absence of solid uncolored sediment.

Test results are shown in Table 1 below.

TABLE 1

Benefit of Modifying the Carrier with Releasing Agent

| | Wash Water Blue? | | Sediment Present? | | |
|---|---|---|---|---|---|
| Sample | After 1 Minute | After 5 Minutes | After 1 Minute | After 5 Minutes | Comments |
| Example 1A | Yes | Yes | Extremely low amount. | Almost None. | Amount of sediment at 1 minute was less than amount of sediment in Comp. Example 1A at 5 minutes. Wash water at 1 minute was more blue in color than wash water of Comp. Example 1A at 5 minutes. Stirred briefly and sediment was gone at 5 minutes. |
| Example 1B | No | Very slight; more than Comp. Ex. 1A | Yes | Yes | Amount of sediment at 1 minute was about equal to Comp. Example 1A at 1 minute. Stirred briefly, but sediment was still present after 5 minutes. |
| Example 1C | Yes | Yes | None | None | Blue coloration and sediment amount about equal to Example 1A; may be slightly better. |
| Example 1D | Yes | Yes | None | None | Blue coloration and sediment amount about equal to Examples 1A and 1C, or possibly slightly better. |
| Comparative Example 1A | No | Extremely slight | Yes | Yes | Sediment amount at 5 minutes was less than amount at 1 minute. Wash water was not blue at 1 minute; it was a very, very slight blue at 5 minutes. Even after stirring at 5 minutes, sediment remained. |
| Comparative Example 1D | No | No | No color. A lot of sediment present. | No color seems to be carried out of the sediment over 5 minutes. A lot of very fine sediment was present. | After stirring, a very mild blue color was observed. Sediment was still present and contained color. |

The test results illustrate that the modification of the clay carrier with a releasing agent (e.g. $MgSO_4$ salt) leads to a substantial decrease in the amount of time it takes to release the coloring agent from the colored speckle. A releasing agent may therefore be used to make a quick color-releasing speckle with a porous clay carrier.

Test 2: Applicability to Other Porous Carriers

This test illustrates that similar quick, color-releasing, non-bleeding, and non-staining speckles can be produced with other porous carriers containing a releasing agent and a coloring agent.

The following colored speckles were prepared:

Example 2A[2]

| Ingredients | Amount (grams) |
|---|---|
| Granulated chalk (gypsum) | 25 |
| Magnesium sulfate (releasing agent) | 17.5 |
| Liquitint ® Blue HP (polymeric colorant coloring agent) | 0.87 |

Comparative Example 2A[1]

| Ingredients | Amount (grams) |
|---|---|
| Granulated chalk (gypsum) | 25 |
| Liquitint ® Blue HP (polymeric colorant coloring agent) | 0.51 |

[1] Samples made via Procedure 1.

[2] Samples made via Procedure 2.

The resulting colored speckles were added to Tide® powder laundry detergent. One gram of the speckle-containing detergent was added to a clear plastic cup which contained 150 mL of cold water. This mixture was gently stirred with a cotton swap for 30 seconds. The mixture was allowed to rest for 5 minutes, and then the mixture was stirred again with a cotton swap for 5 seconds.

The color of the wash water in the plastic cup was then observed to see if it changed to blue and to determine if sediment was present in the bottom of the cup. The speckles were also evaluated for various parameters such as quickness of the color release into the wash water. "Sediment" refers to the dispersed, water insoluble carrier that settles to the bottom of the cup under gravity. This sediment may have varying degrees of color depending on how much of the color has released into the wash water solution. The observation of no sediment being present is intended to describe that all visible traces of color have come off the speckles; it is not intended to describe the actual absence of solid uncolored sediment.

Test results are shown in Table 2 below.

TABLE 2

Applicability to Other Porous Carriers and Their Effect on the Rate of Color Release

| Sample | Instant Release of Color? | Sediment Present? After 1 Minute | Sediment Present? After 5 Minutes | Comments |
|---|---|---|---|---|
| Example 2A | Yes. As soon as water hits the mixture in the bottom of the cup. | Solution blue after 30 seconds with stirring. Speckles not disintegrated. | No disintegration at all. | The detergent contained 2.8% of the colored speckle. |
| Comparative Example 2A | No. | None of the speckles disintegrated, even after stirring. No color release. | Tiny amount of color released during the course of 5 minutes. After stirring, still no disintegration at all. | The detergent contained 2.8% of the colored speckle. |

The test results illustrate that the modification of the chalk (e.g. gypsum) carrier with a releasing agent (e.g. $MgSO_4$ salt) leads to a substantial decrease in the amount of time it takes to release the coloring agent from the colored speckle. The releasing agent can therefore be used to make a quick color-releasing speckle with a porous chalk carrier.

Furthermore, test results provided herein illustrate that modification with a releasing agent leads to a decrease in the release time of the coloring agent from the colored speckle, regardless of the chemical nature of the porous carrier (e.g. clay or chalk).

Test 3: Use of Other Releasing Agents

This test illustrates the use of other water soluble materials as releasing agents and their effect on the rate of color release.

The following colored speckles were prepared:

Example 3A[3,4]

| Ingredients | Amount (grams) |
|---|---|
| Granulated Argel ® 10 (clay carrier) | 50 |
| Alkoxylated m-toluidine with 5EO groups (releasing agent) | 0.75 |
| Stripped Liquitint ® Blue HP (100% solids) | 0.25 |

Comparative Example 3A[1,4]

| Ingredients | Amount (grams) |
|---|---|
| Granulated Argel ® 10 (clay carrier) | 50 |
| Liquitint ® Blue HP (polymeric colorant coloring agent) | 0.25 |

Example 3B[2]

| Ingredients | Amount (grams) |
|---|---|
| Pelben ® 10 (clay carrier) | 25 |
| Sodium sulfate (releasing agent) | 3.9 |
| Liquitint ® Blue HP (polymeric colorant coloring agent) | 0.85 |

Example 3C[2]

| Ingredients | Amount (grams) |
|---|---|
| Pelben ® 10 (clay carrier) | 25 |
| Soda Ash (releasing agent) | 3.9 |
| Liquitint ® Blue HP (polymeric colorant coloring agent) | 0.85 |

Example 3D[2,4]

| Ingredients | Amount (grams) |
|---|---|
| Granulated Argel ® 10 (clay carrier) | 50 |
| Sodium chloride (releasing agent) | 17.5 |
| Liquitint ® Blue HP (polymeric colorant coloring agent) | 1.75 |

Example 3E[2]

| Ingredients | Amount (grams) |
|---|---|
| Pelben ® 10 (clay carrier) | 50 |
| Sucrose (releasing agent) | 35 |
| Liquitint ® Blue HP (polymeric colorant coloring agent) | 1.74 |

[1] Samples made via Procedure 1.
[2] Samples made via Procedure 2.
[3] Samples made via Procedure 3.
[4] Samples made via Procedure 4.

The resulting colored speckles were added to Tide® powder laundry detergent. One gram of the speckle-containing detergent was added to a clear plastic cup which contained 150 mL of cold water. This mixture was gently stirred with a cotton swap for 30 seconds. The mixture was allowed to rest for 5 minutes, and then the mixture was stirred again with a cotton swap for 5 seconds.

The color of the wash water in the plastic cup was then observed to see if it changed to blue and to determine if sediment was present in the bottom of the cup. The speckles were also evaluated for various parameters such as quickness of the color release into the wash water. "Sediment" refers to the dispersed, water insoluble carrier that settles to the bottom of the cup under gravity. This sediment may have varying degrees of color depending on how much of the color has released into the wash water solution. The observation of no sediment being present is intended to describe that all visible traces of color have come off the speckles; it is not intended to describe the actual absence of solid uncolored sediment.

Test results are provided in Table 3.

TABLE 3

Use of Other Releasing Agents and Their Effect on the Rate of Color Release

| | Observations | | Comments |
|---|---|---|---|
| Sample | After 1 Minute | After 5 Minutes | N/A |
| Example 3A | Color release occurred, but very, very light blue color. Sediment was present. | Small amount of sediment was present. Colored solution was a mild blue. | Solution stirred after 5 minutes and the sediment disappeared. Solution was still a mild blue. |
| Comparative Example 3A | Speckles disintegrated with color still in them. Very mild color in solution, but it was definitely blue. | Solution gradually turned more and more blue over 5 minutes. | 0.5% color on speckle. Solution stirred after 5 minutes and 60-70% of the sediment still present, but water was definitely blue. |
| Example 3B | No instant release of color. Solution blue after 30 seconds of stirring. Most speckles gone. Little sediment. Speckles completely disintegrated. | Solution blue after 30 seconds of stirring. Most speckles gone. Little sediment remained. Speckles completely disintegrated. After stirring, 50-60% of sediment disappeared. | The detergent contained 2.8% of the colored speckle. |

TABLE 3-continued

| Use of Other Releasing Agents and Their Effect on the Rate of Color Release | | | |
|---|---|---|---|
| | Observations | | Comments |
| Sample | After 1 Minute | After 5 Minutes | N/A |
| Example 3C | Instant release of color (blue before stirring). Solution blue after 30 seconds of stirring. Most speckles gone. Little sediment. Speckles completely disintegrated. | Solution blue after 30 seconds of stirring. Most speckles gone. Little sediment remained. Speckles completely disintegrated. After stirring, 50-60% of sediment disappeared. | The detergent contained 2.8% of the colored speckle. |
| Example 3D | Instant release of color. Small amount of sediment was present. | Small amount of sediment was present. | Stirred briefly and sediment was still present, but much less after 5 minutes. |
| Example 3E | Instant release of color. Wash water turned blue on addition of water. Very, very little sediment present. | Instant release of color. Wash water turned blue on addition of water. Very, very little sediment present. | N/A |

The test results illustrate that modification of the clay carrier with water soluble materials, other than $MgSO_4$ salt, also leads to a substantial decrease in the amount of time it takes to release the coloring agent from the colored speckle. The test results also show that the addition of alkoxylated m-toluidine to the coloring agent, prior to application to the carrier, appears to aid in the release of coloring agent from the carrier, as evidenced by the lack of colored sediment present in Example 3A in comparison to Comparative Example 3A.

Test 4: Bleed Resistance of Colored Speckles

This test compares the bleed resistance of the colored speckles of the present invention. The colored speckles of Example 1A, which were made from a porous carrier modified with a releasing agent, were tested. In addition, Example 4A was prepared as described below and was also tested for bleed resistance. In general, Example 4A was made by spraying the same color used in Example 1A onto a carbonate carrier and protecting, or coating, the coloring agent with bleed prevention coatings.

The following sample, representing an alternative route to quick color-releasing speckles, was prepared:

Comparative Example 4

| Ingredients | Amount (percent) |
|---|---|
| Soda Ash (granular carrier) | 86.22 |
| Corn Oil (bleed inhibitor) | 6.89 |
| Starch coating (coating/bleed inhibition agent) | 5.17 |
| Liquitint ® Blue HP (polymeric colorant coloring agent) | 1.72 |

For Comparative Example 4, the Liquitint® Blue HP polymeric colorant was first sprayed onto the soda ash granules followed by the spray application of the corn oil and then the starch coating to the colorant-containing soda ash granules, according to methods described in Procedure 2.

Each sample tested for bleed resistance was prepared by adding 0.45 grams of the colored speckles to 30 grams of Breeze powder laundry detergent (a commercially available powder laundry detergent available from Unilever). The mixture was then placed in an unlined cardboard box in a controlled environment at 80% relative humidity and 37° C. for a four week period of time. Each sample was then visually evaluated for the amount of color bleed that was observed to occur in the surrounding powder laundry detergent.

Example 1A and Example 4A were compared and visually evaluated for bleed resistance after four weeks in the Breeze powder laundry detergent. Example 1A appeared to exhibit significantly greater bleed resistance than Example 4A. While Example 4A showed significant bleeding after 4 weeks, Example 1A showed little to no bleed on the same detergent.

Thus, the test results illustrate that the use of a porous carrier modified with a releasing agent provides a colored speckle that rapidly releases color into wash water, but also displays good bleed resistance in humid conditions.

Test 5: Stain Testing of Colored Speckles

This test illustrates the non-staining property of the colored speckles of the present invention. Example 1B, as described herein, was independently added to the following powdered laundry detergents: Surf® (from Unilever), Tide® (from Procter & Gamble), OMO (from Unilever), Breeze (from Unilever), and Coral (from Unilever). Each sample was then tested according to Spot Staining Test Procedure A described herein. Test results are provided in Table 5.

TABLE 5

| Stain Testing of Colored Speckles | | | | | | | | | | | | | | | |
|---|---|---|---|---|---|---|---|---|---|---|---|---|---|---|---|
| Sample | Surf ® | | | Tide ® | | | OMO | | | Breeze | | | Coral | | |
| Example 1B | 5 | 5 | 5 | 5 | 5 | 5 | 5 | 5 | 5 | 5 | 5 | 5 | 5 | 5 | 4.5 |
| Average Example 1B | | 5 | | | 5 | | | 5 | | | 5 | | | 4.8 | |

Test 6: Benefit of Modifying the Carrier with Releasing Agent: Applicability to Other Classes of Polymeric Colorants and Commercial Dyes This test illustrates the color release rate of polymeric colorants and commercial dyes which have been added to carriers with and without the inclusion of a releasing agent.

Two types of colored speckles were prepared by independently adding coloring agent or commercial dye to Pelben® 10 clay carrier. "Type A" colored speckles were modified with 17 grams of magnesium sulfate releasing agent, as described previously in Procedure 2, prior to the addition of the coloring agent. "Type B" colored speckles did not include any magnesium sulfate releasing agent, as described previously in Procedure 1, prior to the addition of the coloring agent.

The following polymeric colorant coloring agents and commercial dyes were tested:

Example 6A: Liquitint® Aztec Yellow lot 2009072027 (Phenyl based Azo) with $MgSO_4$ Comparative Example 6A: Liquitint® Aztec Yellow lot 2009072027 (Phenyl based Azo) with no $MgSO_4$ Example 6B: Liquitint® Orange X-96 (Bis-Azo) with $MgSO_4$ Comparative Example 6B: Liquitint® Orange X-96 (Bis-Azo) with no $MgSO_4$ Example 6C: Liquitint® Yellow LP lot E1279 (Methine Colorants) with $MgSO_4$ Comparative Example 6C: Liquitint® Yellow LP lot E1279 (Methine Colorants) with no $MgSO_4$ Example 6D: Liquitint® Red BL lot T1102 (H-Acid based Azo) with $MgSO_4$ Comparative Example 6D: Liquitint® Red BL lot T1102 (H-Acid based Azo) with no $MgSO_4$ Example 6E: Liquitint® Bright Blue/PC Cyan lot 2008242278 (Phthalocyanine) with $MgSO_4$ Comparative Example 6E: Liquitint® Bright Blue/PC Cyan lot 2008242278 (Phthalocyanine) with no $MgSO_4$ Example 6F: Liquitint® Pink lot 2008469216 (Naphthol based Azo) with $MgSO_4$ Comparative Example 6F: Liquitint® Pink lot 2008469216 (Naphthol based Azo) with no $MgSO_4$ Example 6G: Liquitint® Violet CT (AMTC based Azo) with $MgSO_4$ Comparative Example 6G: Liquitint® Violet CT (AMTC based Azo) with no $MgSO_4$ Example 6H: Liquitint® Red ST lot A1091 (Benzothiazole Azo) with $MgSO_4$ Comparative Example 6H: Liquitint® Red ST lot A1091 (Benzothiazole Azo) with no $MgSO_4$ Example 6I: Liquitint® Patent Blue lot P1954 (TPM) with $MgSO_4$ Comparative Example 6I: Liquitint® Patent Blue lot P1954 (TPM) with no $MgSO_4$ Example 6J: FD&C Blue 1 lot HD138 (Water Soluble Commercial Dye) with $MgSO_4$ Comparative Example 6J: FD&C Blue 1 lot HD138 (Water Soluble Commercial Dye) with no $MgSO_4$ Example 6K: Solvent Blue 35 lot 07020KZ (Water Insoluble Commercial Dye) with $MgSO_4$ Comparative Example 6K: Solvent Blue 35 lot 07020KZ (Water Insoluble Commercial Dye) with no $MgSO_4$ Example 6L: Acid Blue 80 (Water Soluble Commercial Dye) with $MgSO_4$ Comparative Example 6L: Acid Blue 80 (Water Soluble Commercial Dye) with no $MgSO_4$ Example 6M: Direct Violet 9 lot C1141 (Azo Dye) with $MgSO_4$ Comparative Example 6M: Direct Violet 9 lot C1141 (Azo Dye) with no $MgSO_4$ The prepared colored speckles were added to Tide® powder laundry detergent such that the detergent contained 2% by weight of the colored speckles. One gram of the speckle-containing detergent was added to a clear plastic cup which contained 150 mL of cold water. This mixture was gently stirred with a cotton swap for 30 seconds. The speckles were evaluated for quickness of the color release into the wash water. Test results are provided in Table 6.

The following colored speckles were prepared:

Example 6A[2]

| Ingredients | Amount (grams) |
|---|---|
| Pelben ® 10 (clay carrier) | 50 |
| Magnesium Sulfate (releasing agent) | 17 |
| Liquitint ® Aztec Yellow (polymeric colorant coloring agent) | 1.36 |

Comparative Example 6A[1]

| Ingredients | Amount (grams) |
|---|---|
| Pelben ® 10 (clay carrier) | 50 |
| Liquitint ® Aztec Yellow (polymeric colorant coloring agent) | 1.02 |

Example 6B[2]

| Ingredients | Amount (grams) |
|---|---|
| Pelben ® 10 (clay carrier) | 50 |
| Magnesium Sulfate (releasing agent) | 17 |
| Liquitint ® Orange X-96 (polymeric colorant coloring agent) | 1.36 |

Comparative Example 6B[1]

| Ingredients | Amount (grams) |
|---|---|
| Pelben ® 10 (clay carrier) | 50 |
| Liquitint ® Orange X-96 (polymeric colorant coloring agent) | 1.02 |

Example 6C[2]

| Ingredients | Amount (grams) |
|---|---|
| Pelben ® 10 (clay carrier) | 50 |
| Magnesium Sulfate (releasing agent) | 17 |
| Liquitint ® Yellow LP (polymeric colorant coloring agent) | 1.36 |

Comparative Example 6C[1]

| Ingredients | Amount (grams) |
|---|---|
| Pelben ® 10 (clay carrier) | 50 |
| Liquitint ® Yellow LP (polymeric colorant coloring agent) | 1.02 |

Example 6D[2]

| Ingredients | Amount (grams) |
|---|---|
| Pelben ® 10 (clay carrier) | 50 |
| Magnesium Sulfate (releasing agent) | 17 |
| Liquitint ® Red BL (polymeric colorant coloring agent) | 1.36 |

Comparative Example 6D[1]

| Ingredients | Amount (grams) |
|---|---|
| Pelben ® 10 (clay carrier) | 50 |
| Liquitint ® Red BL (polymeric colorant coloring agent) | 1.02 |

Example 6E[2]

| Ingredients | Amount (grams) |
|---|---|
| Pelben ® 10 (clay carrier) | 50 |
| Magnesium Sulfate (releasing agent) | 17 |
| Liquitint ® Bright Blue (polymeric colorant coloring agent) | 1.36 |

Comparative Example 6E[1]

| Ingredients | Amount (grams) |
|---|---|
| Pelben ® 10 (clay carrier) | 50 |
| Liquitint ® Bright Blue (polymeric colorant coloring agent) | 1.02 |

Example 6F[2]

| Ingredients | Amount (grams) |
|---|---|
| Pelben ® 10 (clay carrier) | 50 |
| Magnesium Sulfate (releasing agent) | 17 |
| Liquitint ® Pink (polymeric colorant coloring agent) | 1.36 |

Comparative Example 6F[1]

| Ingredients | Amount (grams) |
|---|---|
| Pelben ® 10 (clay carrier) | 50 |
| Liquitint ® Pink (polymeric colorant coloring agent) | 1.02 |

Example 6G[2]

| Ingredients | Amount (grams) |
|---|---|
| Pelben ® 10 (clay carrier) | 50 |
| Magnesium Sulfate (releasing agent) | 17 |
| Liquitint ® Violet CT (polymeric colorant coloring agent) | 1.36 |

Comparative Example 6G[1]

| Ingredients | Amount (grams) |
|---|---|
| Pelben ® 10 (clay carrier) | 50 |
| Liquitint ® Violet CT (polymeric colorant coloring agent) | 1.02 |

Example 6H[2]

| Ingredients | Amount (grams) |
|---|---|
| Pelben ® 10 (clay carrier) | 50 |
| Magnesium Sulfate (releasing agent) | 17 |
| Liquitint ® Red ST (polymeric colorant coloring agent) | 1.36 |

Comparative Example 6H[1]

| Ingredients | Amount (grams) |
|---|---|
| Pelben ® 10 (clay carrier) | 50 |
| Liquitint ® Red ST (polymeric colorant coloring agent) | 1.02 |

Example 6I[2]

| Ingredients | Amount (grams) |
|---|---|
| Pelben ® 10 (clay carrier) | 50 |
| Magnesium Sulfate (releasing agent) | 17 |
| Liquitint ® Patent Blue (polymeric colorant coloring agent) | 1.36 |

Comparative Example 6I[1]

| Ingredients | Amount (grams) |
|---|---|
| Pelben ® 10 (clay carrier) | 50 |
| Liquitint ® Patent Blue (polymeric colorant coloring agent) | 1.02 |

Example 6J[2]

| Ingredients | Amount (grams) |
|---|---|
| Pelben ® 10 (clay carrier) | 50 |
| Magnesium Sulfate (releasing agent) | 17 |
| FD&C Blue (commercial dye available from) Spectrum Chemical Mfg. Co.) | 1.36 |

Comparative Example 6J[1]

| Ingredients | Amount (grams) |
|---|---|
| Pelben ® 10 (clay carrier) | 50 |
| FD&C Blue (commercial dye) | 1.02 |

Example 6K[2]

| Ingredients | Amount (grams) |
|---|---|
| Pelben ® 10 (clay carrier) | 50 |
| Magnesium Sulfate (releasing agent) | 17 |
| Solvent Blue 35 (commercial dye available from Aldrich Chemical Co.) | 1.36 |

Comparative Example 6K[1]

| Ingredients | Amount (grams) |
|---|---|
| Pelben ® 10 (clay carrier) | 50 |
| Solvent Blue 35 (commercial dye) | 1.02 |

Example 6L[2]

| Ingredients | Amount (grams) |
|---|---|
| Pelben ® 10 (clay carrier) | 50 |
| Magnesium Sulfate (releasing agent) | 17 |
| Acid Blue 80 (a commercial dye available from Aceto) | 4.27 |

Comparative Example 6L[1]

| Ingredients | Amount (grams) |
|---|---|
| Pelben ® 10 (clay carrier) | 50 |
| Acid Blue 80 (commercial dye) | 3.2 |

Example 6M[2]

| Ingredients | Amount (grams) |
|---|---|
| Pelben ® 10 (clay carrier) | 50 |
| Magnesium Sulfate (releasing agent) | 17 |
| Direct Violet 9 (a commercial dye available from Ciba) | 0.67 |

Comparative Example 6M[1]

| Ingredients | Amount (grams) |
|---|---|
| Pelben ® 10 (clay carrier) | 50 |
| Direct Violet 9 (commercial dye) | 0.51 |

[2] Samples made via Procedure 1.

[2] Samples made via Procedure 2.

TABLE 6

Benefit of Modifying the Carrier with Releasing Agent: Applicability to Other Classes of Other Polymeric Colorants and Commercial Dyes

| Sample | Class | Comments |
|---|---|---|
| Example 6A Comparative Example 6A | Phenyl Based Azo | Much quicker color release from salt modified sample |
| Example 6B Comparative Example 6B | Bis-Azo | Much quicker color release from salt modified sample |
| Example 6C Comparative Example 6C | Methine | Much quicker color release from salt modified sample |
| Example 6D Comparative Example 6D | H-Acid Based Azo | Much quicker color release from salt modified sample |
| Example 6E Comparative Example 6E | Phthalocyanine | Much quicker color release from salt modified sample |
| Example 6F Comparative Example 6F | Naphthol Based Azo | Much quicker color release from salt modified sample |
| Example 6G Comparative Example 6G | AMTC Based Azo | No enhanced color release from salt modification |
| Example 6H Comparative Example 6H | Benzothiazole Azo | Much quicker color release from salt modified sample |

TABLE 6-continued

Benefit of Modifying the Carrier with Releasing Agent: Applicability to Other Classes of Other Polymeric Colorants and Commercial Dyes

| Sample | Class | Comments |
|---|---|---|
| Example 6I Comparative Example 6I | TPM | Much quicker color release from salt modified sample |
| Example 6J Comparative Example 6J | Water Soluble Commercial Dye | Much quicker color release from salt modified sample |
| Example 6K Comparative Example 6K | Water Insoluble Commercial Dye | Much quicker color release from salt modified sample |
| Example 6L Comparative Example 6L | Water Soluble Commercial Dye | No enhanced color release from salt modification |
| Example 6M Comparative Example 6M | Azo Dye | Much quicker color release from salt modified sample |

The test results illustrate that the colored speckles that were modified with a releasing agent exhibited an enhanced rate of color release for all classes of Liquitint® polymeric colorants, except for the AMTC-based Azo class represented by Liquitint® Violet CT. Additionally, the test results illustrate that the colored speckles that were modified with a releasing agent exhibited an enhanced rate of color release for the FD&C Blue, Patent Blue, Solvent Blue, and Direct Violet 9 commercial dyes. The test results illustrate that the release rate of Acid Blue 80 from the clay carrier does not appear to be enhanced by modification with magnesium sulfate releasing agent.

Test 7: Evaluation of Staining in Natural Vs. Synthetic Clay Carrier Materials The following samples were prepared generally according to Procedure 5, unless otherwise noted by the Process Description.

TABLE 7

Natural and Synthetic Carrier Materials with Coloring Agent

| Sample | Coloring Agent and Loading Amount | Carrier Material | Process Description |
|---|---|---|---|
| 7-1 | 2% Liquitint ® Violet DD (VDD) | Pelben ® 10, synthetic sodium bentonite clay | Converted from granulated form to powder form and then colored in lab. |
| 7-2 | 2% VDD | Pelben ® 35, natural sodium bentonite clay | Converted from granulated form to powder form and then colored in lab. |
| 7-3 | 2% VDD | Argel ® 40, natural sodium bentonite clay | Already in powder form as received from manufacturer; colored in lab. |
| 7-4 | 2% VDD | Pelben ® 10 + 20 kg/ton VDD | Already colored as received from manufacturer. Converted from granulated form to powder form in lab. |
| 7-5 | 2% VDD | Pelben ® 35 + 2% VDD | Already colored as received from manufacturer. Converted from granulated form to powder form in lab. |
| 7-6 | 3% VDD | Pelben ® 35 + 3% VDD | Already colored as received from manufacturer. Converted from granulated form to powder form in lab. |
| 7-7 | 2% VDD | Synthetic sodium bentonite clay granules from AMCOL ® | Converted from granulated form to powder form and then colored in lab. |
| 7-8 | 3% VDD | Synthetic sodium bentonite clay granules from AMCOL ® | Converted from granulated form to powder form and then colored in lab. |

TABLE 7-continued

Natural and Synthetic Carrier Materials with Coloring Agent

| Sample | Coloring Agent and Loading Amount | Carrier Material | Process Description |
|---|---|---|---|
| 7-9 | 2% VDD | Calcium bentonite clay granules from AMCOL ® | Converted from granulated form to powder form and then colored in lab. |
| 7-10 | 3% VDD | Calcium bentonite clay granules from AMCOL ® | Converted from granulated form to powder form and then colored in lab. |
| 7-11 | 2% VDD | Calcium bentonite clay granules from AMCOL ® | Already colored as received from manufacturer. Converted from granulated form to powder form in lab. |
| 7-12 | 2% VDD | Natural sodium bentonite clay from Fisher, B-235 Lot#744491 | Already in powder form as received from manufacturer; colored in lab. |
| 7-13 | 3% VDD | Natural sodium bentonite clay from Fisher, B-235 Lot#744491 | Already in powder form as received from manufacturer; colored in lab. |
| 7-14 | 2% Ultramarine Blue (UMB) | Pelben ® 10, synthetic sodium bentonite clay | Converted from granulated form to powder form and then colored in lab. |
| 7-15 | 2% UMB | Argel ® 40, natural sodium bentonite clay | Already in powder form as received from manufacturer; colored in lab. |
| 7-16 | 2% Direct Violet 9 | Pelben ® 10, synthetic sodium bentonite clay | Converted from granulated form to powder form and then colored in lab. |
| 7-17 | 2% Direct Violet 9 | Argel ® 40, natural sodium bentonite clay | Already in powder form as received from manufacturer; colored in lab. |
| 7-18 | 0.2% Direct Violet 9 | Pelben ® 10, synthetic sodium bentonite clay | Converted from granulated form to powder form and then colored in lab. |
| 7-19 | 0.2% Direct Violet 9 | Argel ® 40, natural sodium bentonite clay | Already in powder form as received from manufacturer; colored in lab. |

Each of the samples in Table 7 was evaluated for staining according to Spot Staining Test Procedure B. The test results are provided in Table 7-A.

TABLE 7-A

Spot Staining Test Results for Natural vs. Synthetic Clay Carrier Materials

| Sample | Visual Observations After Rinse & Dry |
|---|---|
| 7-1 | Very bad staining |
| 7-2 | No staining |
| 7-3 | No staining |
| 7-4 | Very bad staining; equivalent to or worse than 7-1. |
| 7-5 | No staining |
| 7-6 | No staining; very mild hue; almost not observable |
| 7-7 | Staining; much milder than 7-1, but significantly worse than 7-6 |
| 7-8 | Staining; worse than 7-7; milder than 7-1. |
| 7-9 | Same as 7-7 |
| 7-10 | Same as 7-8 |
| 7-11 | Staining;/as bad as 7-8 and 7-10; maybe slightly worse |
| 7-12 | No staining |
| 7-13 | No staining |
| 7-14 | No staining |
| 7-15 | No staining |
| 7-16 | Very bad staining |
| 7-17 | Very bad staining. no observable difference between 7-16 and 7-17 |
| 7-18 | Staining |
| 7-19 | Staining; noticeably milder than 7-18 |

The test results indicate that, for equivalent Violet DD color loading, colored (with Violet DD) natural sodium bentonite (Pelben® 35 or Argel® 40) powder provides less staining than colored (with Violet DD) synthetic sodium bentonite (Pelben® 10) powder. This result appears to be true regardless of the source of the natural sodium bentonite (e.g. Buntech or Fisher Scientific).

For equivalent, low (0.2%) Direct Violet 9 color loading, colored (with Direct Violet 9) natural sodium bentonite (Pelben® 35 or Argel® 40) powder provides less staining than colored (with Direct Violet 9) synthetic sodium bentonite (Pelben® 10) powder. However, this effect appears to be lost at higher (2%) Direct Violet 9 color loading.

For equivalent, Ultramarine Blue color loading, colored (with Ultramarine Blue) natural sodium bentonite (Pelben® 35 or Argel® 40) powder provides equivalent staining as colored (with Ultramarine Blue) synthetic sodium bentonite (Pelben® 10) powder.

For equivalent Violet DD color loading, colored calcium bentonite (powdered and colored in lab) from AMCOL® provides equivalent staining as colored synthetic sodium bentonite (powdered and colored in lab) from AMCOL®.

Test 8: Evaluation of Staining in Natural Vs. Synthetic (Partially and Fully Activated) Clay Carrier Materials The following samples were prepared according to Procedure 5. All of the carrier materials were obtained from AMCOL®. Each of the partially activated and fully activated bentonite carrier materials are synthetic sodium bentonites.

TABLE 8

Partially Activated, Fully Activated, and Natural Bentonite Clay Powder Materials Colored with Liquitint ® Violet DD Coloring Agent

| Sample | Coloring Agent and Loading Amount | Carrier Material |
|---|---|---|
| 8-1 | 2% VDD | Partially activated synthetic sodium bentonite clay powder |
| 8-2 | 2% VDD | Fully activated synthetic sodium bentonite clay powder |
| 8-3 | 2% VDD | Natural sodium bentonite clay powder |
| 8-4 | 3% VDD | Partially activated synthetic sodium bentonite clay powder |
| 8-5 | 3% VDD | Fully activated synthetic sodium bentonite clay powder |
| 8-6 | 3% VDD | Natural sodium bentonite clay powder |

Each of the samples in Table 8 was evaluated for staining according to Spot Staining Test Procedure B. The test results are provided in Table 8-A.

TABLE 8-A

Spot Staining Test Results for Natural vs. Synthetic (Partially and Fully Activated) Clay Carrier Materials

| Sample | Visual Observations After Rinse & Dry |
|---|---|
| 8-1 | Moderate/Bad Staining |
| 8-2 | Noticeably Milder Staining than 8-1 |
| 8-3 | Easily the Mildest Staining when compared to 8-1 and 8-2 |
| 8-4 | Moderate/Bad Staining |
| 8-5 | Noticeably Milder Staining than 8-4 |
| 8-6 | Easily the Mildest Staining when compared to 8-4 and 8-5 |

For equivalent Violet DD color loading, the colored (with VDD) natural sodium bentonite powder provides less staining than the colored (with VDD) "activated" grades of bentonite powder (both partially and fully activated grades, which are synthetic sodium bentonites).

For equivalent Violet DD color loading, the colored (with VDD) fully activated bentonite powder provides less staining that the colored (with VDD) partially activated bentonite powder.

The test results show that as the clay carrier material becomes more like the natural sodium bentonite, its propensity for fabric staining decreases. Without being bound by theory, it is believed that this effect may be related to the swelling properties of the clay carrier materials. Natural sodium bentonite tends to exhibit the most swelling when placed in an aqueous environment, while calcium bentonite tends to exhibit is the least amount of swelling. For synthetic sodium bentonites (partially and fully activated), as more and more of the calcium ions are substituted with sodium ions (by soda ash treatment of the calcium bentonite for example), the swelling of the clay material progressively increases.

Test 9: Evaluation of Staining in Natural Vs. Synthetic Clay Carrier Materials as Affected by Particle Size The following samples were prepared as described herein. Each sample was then tested for staining according to Spot Staining Test Procedure B.

Part A—Dividing speckles by particle size

1. Sodium bentonite and calcium bentonite clay carrier material (granules/speckles) from AMCOL® were independently sifted. The clay carrier material that was retained by the #25 and #20 sieves for each of the sodium and calcium bentonite materials were separated.
2. Pelben® 10 and Pelben® 35 bentonite from Buntech were independently sifted and the clay carrier material that was retained by the #25 sieve for each of the bentonite materials was kept separate.

Sample 9-1: Calcium Bentonite #25 (AMCOL®)+3% VDD 1. 50 g of the calcium bentonite clay carrier material that was retained by the #25 sieve was put into the drum of a tumble mixer.
2. 2.1 g of Liquitint® Violet DD (Lot PP012) was diluted to 5 g with DI water (this is 3% color times 1.4 to compensate for color loss to the drum.)
3. The colored solution was then sprayed onto the clay carrier material while the drum was rotating. The colored speckles thus produced were then spread out flat on a piece of foil to dry overnight. (Final wt % moisture=9.54%)

Sample 9-2: Calcium Bentonite #20 (AMCOL®)+3% VDD 1. 30 g of the calcium bentonite clay carrier material that was retained by the #20 sieve was put into the drum of a tumble mixer.
2. 1.26 g of Liquitint® Violet DD (Lot PP012) was diluted to 5 g with DI water (this is 3% color times 1.4 to compensate for color loss to the drum.)
3. The colored solution was then sprayed onto the clay carrier material while the drum was rotating. The colored speckles thus produced were then spread out flat on a piece of foil to dry overnight. (Final wt % moisture=9.82%)

Sample 9-3: Natural Sodium Bentonite #25 (AMCOL®)+3% VDD 1. 50 g of the sodium bentonite material that was retained by the #25 sieve was put into the drum of a tumble mixer.
2. 2.1 g of Liquitint® Violet DD (Lot PP012) was diluted to 5 g with DI water (this is 3% color times 1.4 to compensate for color loss to the drum.)
3. The colored solution was then sprayed onto the clay carrier material while the drum was rotating. The colored speckles thus produced were then spread out flat on a piece of foil to dry overnight. (Final wt % moisture=9.58%)

Sample 9-4: Natural Sodium Bentonite #20 (AMCOL®)+3% VDD 1. 30 g of the sodium bentonite clay carrier material that was retained by the #20 sieve was put into the drum of a tumble mixer.
2. 1.26 g of Liquitint® Violet DD (Lot PP012) was diluted to 5 g with DI water (this is 3% color times 1.4 to compensate for color loss to the drum.)
3. The colored solution was then sprayed onto the clay carrier material while the drum was rotating. The colored speckles thus produced were then spread out flat on a piece of foil to dry overnight. (Final wt % moisture=8.42%)

Sample 9-5: Pelben® 10 #25 (Buntech Synthetic Sodium Bentonite)+3% VDD 1. 50 g of the Pelben® 10 clay carrier material that was retained by the #25 sieve was put into the drum of a tumble mixer.
2. 2.1 g of Liquitint® Violet DD (Lot PP012) was diluted to 5 g with DI water (this is 3% color times 1.4 to compensate for color loss to the drum.)
3. The colored solution was then sprayed onto the clay carrier material while the drum was rotating. The colored speckles thus produced were then spread out flat on a piece of foil to dry overnight. (Final wt % moisture=12.17%)

Sample 9-6: Pelben® 35 #25 (Buntech Natural Sodium Bentonite)+3% VDD 1. 50 g of the Pelben® 35 clay carrier material that was retained by the #25 sieve was put into the drum of a tumble mixer.
2. 2.1 g of Liquitint® Violet DD (Lot PP012) was diluted to 5 g with DI water (this is 3% color times 1.4 to compensate for color loss to the drum.)
3. The colored solution was then sprayed onto the clay carrier material while the drum was rotating. The colored speckles thus produced were then spread out flat on a piece of foil to dry overnight. (Final wt % moisture=9.6%)

TABLE 9

Spot Staining Test Results for Natural vs. Synthetic Clay Carrier Materials Having Varying Particle Size

| Sample | Colored Clay Speckles | After Rinse & Dry |
|---|---|---|
| 9-1 | 3% VDD on AMCOL ® Ca-Bentonite speckles retained on sieve #25 | Very bad staining |
| 9-2 | 3% VDD on AMCOL ® Ca-Bentonite speckles retained on sieve #20 | Very bad staining |
| 9-3 | 3% VDD on AMCOL ® Natural Na-Bentonite speckles retained on sieve #25 | Highly reduced staining compared to 9-1. Mild stains still present. |
| 9-4 | 3% VDD on AMCOL ® Natural Na-Bentonite speckles retained on sieve #20 | Highly reduced staining compared to 9-1. Mild stains still present. |
| 9-5 | 3% VDD on BUNTECH Synthetic Na-Bentonite (Pelben 10) speckles retained on sieve #25 | Very bad staining |
| 9-6 | 3% VDD on BUNTECH Natural Na-Bentonite (Pelben 35) speckles retained on sieve #25 | Highly reduced staining compared to 9-5. Mild stains still present. |

For equivalent Violet DD color loading and equivalent speckle size, the colored speckles containing natural sodium bentonite (Pelben® 35) provides less staining than the colored speckles containing synthetic sodium bentonite (Pelben® 10).

For equivalent Violet DD color loading and equivalent speckle size, the colored speckles containing natural sodium bentonite (from AMCOL®) provides less staining that the colored speckles containing calcium bentonite (from AMCOL®).

A trend of less fabric staining is observed (for equal color loading and in equal particle size) with the transition from calcium or synthetic sodium bentonite to natural bentonite on both powdered and granular forms of these clay carrier materials. However, an increased risk of staining is observed with the transition from powdered natural sodium bentonite to granular natural sodium bentonite for the same loading of VDD.

Thus, the above description and examples show that the inventive colored speckles provide both quick release of non-staining color and bleed resistance to various detergent formulations with which they may be combined. As has been described herein, the inventive colored speckles possess a significant advantage over currently available colored speckles by allowing rapid release of color into wash water, while still preserving bleed resistance and good non-staining properties. As such, the present colored speckles represent a useful advance over the prior art.

These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the scope of the invention described in the appended claims.

We claim:

1. A colored speckle comprising:

(a) at least one porous carrier material, wherein the at least one porous carrier material is characterized by having a plurality of pores and is selected from clays, silicas, zeolites, metal oxides, diatomaceous earth, mica, talc, chalk, gypsum-containing compounds, leaded zinc oxide, zinc oxide, zinc sulfide, lithopone, titanium dioxide, calcium sulfate, antimony oxide, magnesium silicate, barytes, basic lead carbonate, calcium carbonate, calcium sulfate, barium sulfate, calcium silicate, silica flatting agents, aluminum silicate, hydrous aluminum silicates, magnesium silicates, calcium metasilicate, sodium-potassium-aluminum silicate, sodium tripolyphosphate, sodium silicate, soda ash-containing compounds, and combinations thereof, (b) a first layer comprising at least one releasing agent selected from magnesium sulfate, sodium sulfate, sodium carbonate, sodium chloride, and mixtures thereof, wherein the releasing agent is in direct contact with at least a portion of the plurality of pores of the at least one porous carrier material, and (c) a second layer comprising from about 0.01% to about 10% by weight of at least one polymeric colorant, wherein the polymeric colorant contains at one chromophore group attached to at least one oligomeric or polymeric chain, wherein the chain has at least three repeating units, and wherein the polymeric colorant is in direct contact with at least a portion of the releasing agent layer.

2. The colored speckle of claim 1, wherein the at least one porous carrier material is clay.

3. The colored speckle of claim 1, wherein the at least one porous carrier material exhibits an average particle size of between about 0.1 mm and about 2 mm.

4. The colored speckle of claim 1, wherein the at least one porous carrier material exhibits an average particle size of between about 0.3 mm and about 1.2 mm.

5. The colored speckle of claim 1, wherein the salt compound is magnesium sulfate.

6. The colored speckle of claim 1, wherein the at least one releasing agent exhibits solubility in water of from about 20 grams to about 200 grams of releasing agent to 100 grams of water at 20° C.

7. The colored speckle of claim 1, wherein the ratio by weight of the at least one porous carrier to the at least one releasing agent is in the range of about 1000:1 to about 1:1.

8. The colored speckle of claim 1, wherein polymeric colorant is characterized by having a chromophore group is selected from the group consisting of nitroso, nitro, azo (including monoazo, disazo, trisazo, tetrakisazo, polyazo, formazan, azomethine and metal complexes thereof), stilbene, diarylmethane, triarylmethane, xanthene acridine, quinoline, methine (including polymethine), thiazole, indamine, indophenol, azine, thiazine, oxazine, aminoketone, hydroxyketone, anthraquinone (including anthrapyrazolines, anthrone, anthrapyridone, anthrapyrimidine, flavanthrone, pyranthrone, benzanthrone, perylene, perinone, naphthalimide and other structures formally related to anthraquinone), indigoid (including thioindigoid), phthalocyanine chromophore groups, and mixtures thereof.

9. A powdered detergent formulation comprising the colored speckle of claim 1.

10. A method for forming a colored speckle comprising the steps of:

(a) providing at least one porous carrier material selected from clays, silicas, zeolites, metal oxides, diatomaceous earth, mica, talc, chalk, gypsum-containing compounds, leaded zinc oxide, zinc oxide, zinc sulfide, lithopone, titanium dioxide, calcium sulfate, antimony oxide, magnesium silicate, barytes, basic lead carbonate, calcium carbonate, calcium sulfate, barium sulfate, calcium silicate, silica flatting agents, aluminum silicate, hydrous aluminum silicates, magnesium silicates, calcium metasilicate, sodium-potassium-aluminum silicate, sodium tripolyphosphate, sodium silicate, soda ash-containing compounds, and combinations thereof;

(b) applying at least one releasing agent selected from magnesium sulfate, sodium sulfate, sodium carbonate, sodium chloride, and mixtures thereof to the at least one porous carrier material to form a carrier-releasing agent composite; and (c) applying at least one polymeric colorant to the carrier-releasing agent composite to form the colored speckle, wherein the polymeric colorant contains at one chromophore group attached to at least one oligomeric or polymeric chain, wherein the chain has at least three repeating units.

* * * * *

UNITED STATES PATENT AND TRADEMARK OFFICE

CERTIFICATE OF CORRECTION

PATENT NO. : 8,318,652 B2
APPLICATION NO. : 12/851616
DATED : November 27, 2012
INVENTOR(S) : Gregory Fernandes and Eduardo Torres It is certified that error appears in the above-identified patent and that said Letters Patent is hereby corrected as shown below:

In Column 37, line 5, after "group" and before "selected", delete "is"

Signed and Sealed this
Twelfth Day of February, 2013

Teresa Stanek Rea
*Acting Director of the United States Patent and Trademark Office*